US005910648A

United States Patent [19]

Moritz

[11] Patent Number: 5,910,648

[45] Date of Patent: Jun. 8, 1999

[54] SOUND GENERATOR

[75] Inventor: Mats Moritz, Trelleborg, Sweden

[73] Assignee: Kockum Sonics AB, Malmo, Sweden

[21] Appl. No.: 09/037,042

[22] Filed: Mar. 9, 1998

[30] Foreign Application Priority Data

Mar. 13, 1997 [SE] Sweden ..... 9700895

[51] Int. Cl.[6] ..... G10K 11/00

[52] U.S. Cl. ..... 181/175; 181/177

[58] Field of Search ..... 181/143, 152, 181/159, 160, 161, 175, 177, 182; 381/165, 337, 340

[56] References Cited

U.S. PATENT DOCUMENTS 4,763,358 8/1988 Danley ..... 381/165

4,805,732 2/1989 Moritz ..... 181/175

*Primary Examiner*—Khanh Dang

*Attorney, Agent, or Firm*—Laurence R. Brown

[57] ABSTRACT

In a sound generator of the type having a motor powered piston (7-9) limiting a chamber (18) connected to a resonance tube (16) and which is adapted to generate sound waves for cleaning heat exchange surfaces, the piston (7-9) is according the invention provided with two axially spaced piston membranes (8, 9) and a device (19) for establishing a vacuum between the two membranes (8, 9) and thus ensuring only tensile stresses in membranes (8, 9) thereby increasing their life time.

3 Claims, 2 Drawing Sheets

SOUND GENERATOR

FIELD OF THE INVENTION

This invention relates to a sound generator comprising a resonance tube and a device for supplying gas pulses to the resonance tube in which said gas pulses form a standing sound wave, the said device for supplying gas pulses comprising a motor activating an oscillating piston via a connecting rod, the said piston being mounted to form a wall of a chamber connected to the resonance tube.

BACKGROUND ART

The resonance tube of the sound generator is frequently adapted to be connected to a furnace or a drying plant, and the sound waves - often of a low frequency, i.e. a frequency less than about 50 Hz—are used for keeping heat exchange surfaces of the said furnace or drying device free from deposits of soot or material.

As an alternative to the method of providing gas pulses by a motor powered, oscillating piston it is possible to provide the pulses by a valve governed compressed air source. However this method is more expensive in operation.

In some furnaces or drying plants a finely divided material is formed and is liable to enter into the resonance tube and to pass between the piston and its surrounding cylinder wall. This finely divided material may cause wear on the piston rings, the piston and the cylinder wall. It may even pass into the crank casing containing the connecting rod and into the motor and the motor bearings. In plants or devices in which such materials are present or formed it may be necessary to use the more expensive alternative in which the gas pulses are provided by a valve governed supply of compressed air. However, in many cases even this solution is impossible. E. g. in case the abrasive, finely divided material is a nutrient which should not be mingled with compressed air in order to avoid impurities or oxidation.

Leakage between a piston and its surrounding cylinder wall may be avoided by using a membrane piston rigidly clamped at its periphery to a wall of a chamber surrounding the piston. In case of producing a low frequency sound a sinus shaped pressure pulse is provided and passed into the resonance tube. The pressure variations will cause a conventional membrane to flutter between end positions. As a consequence of variations in bending stress it will detonate and crack only after a few million piston strokes which is far from being acceptable.

DISCLOSURE OF THE INVENTION

Sound generators provided with motor powered pistons have previously been described e.g. in the German Patent specification No. 2,149,405 and in the U.S. Pat. No. 4,805,732.

The present invention has for its object to provide a sound generator of the type referred to above which is suitable for generating sound waves having low frequency and being suitable for cleaning heat exchanger surfaces. The components of the sound generator should be reliable during long intervals without risk of detrimental influence of the material handled.

This is according to the present invention obtained thereby that the said piston is a membrane piston comprising two axially spaced membranes fastened to the wall of said chamber, an evacuating channel being provided between the two membranes making it possible to establish a vacuum between the two membranes.

BRIEF DESCRIPTION OF THE DRAWINGS

The invention will be described below in more detail reference being made to the accompanying drawing in which FIG. 1 schematically shows a vertical section through a sound generator according to the invention.

THE PREFERRED EMBODIMENT

Figure 1:
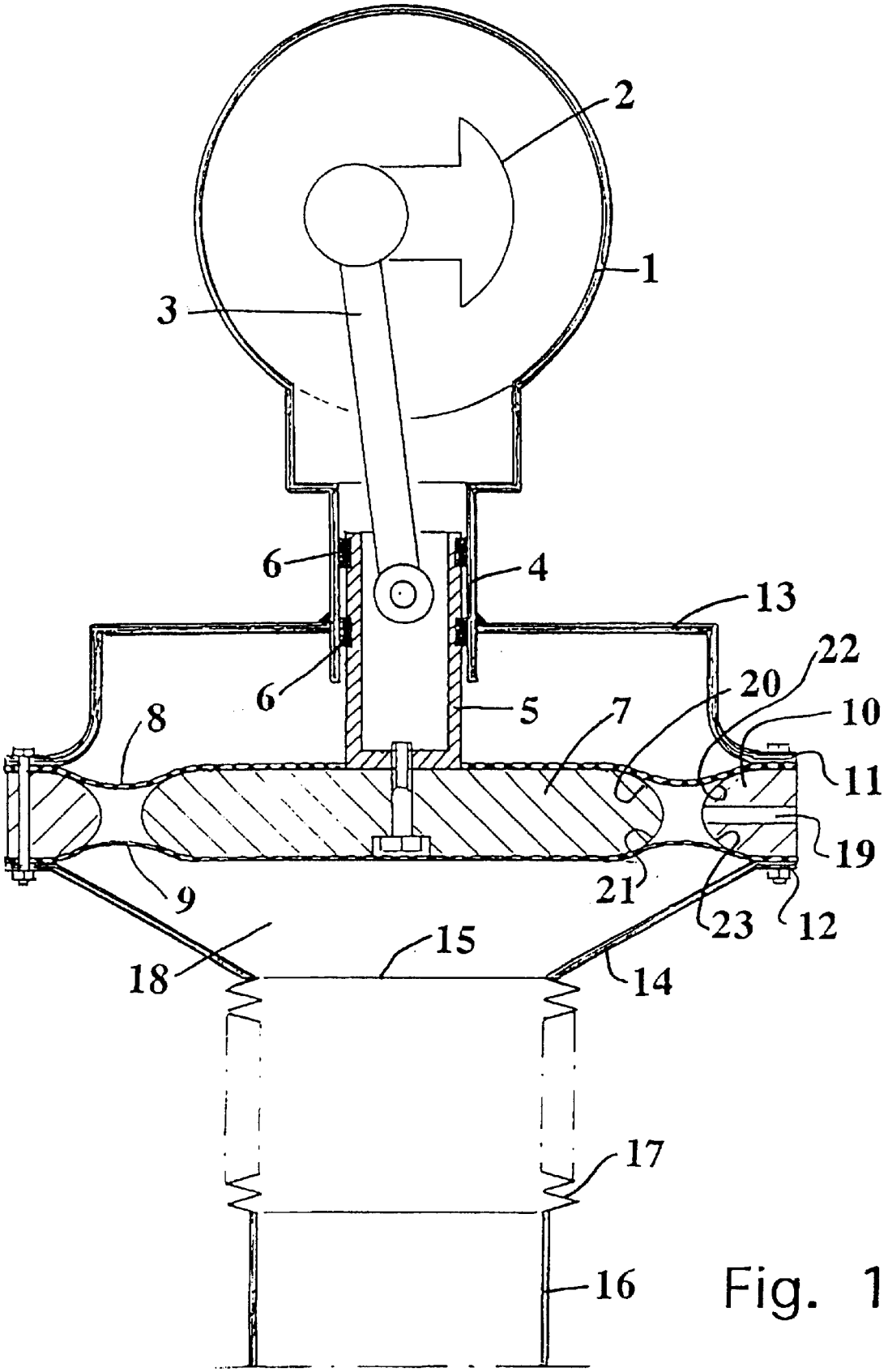

In FIG. 1 the reference numeral 1 designates a crank casing in which a crankshaft 2 powered by a motor—not shown—has been journalled. The crankshaft 2 is fastened to a connecting rod 3 which in turn activates a piston rod 5 supported by a cylindrical guide 4. Between said guide 4 and the piston rod 5 support rings 6 have been fitted.

The lower end of the piston rod 5 has been fastened to a membrane piston consisting of a disc shaped member 7 contacting on its upper as well as on its lower side a membrane 8 resp. a membrane 9. The said two membranes 8 and 9 are clamped between a ring shaped member 10 and flanges 11 and 12 of a housing having two parts 13, 14. The said housing 13, 14 surrounds the piston rod 5 the member 7 and the membranes 8, 9. The lower part 14 of the housing 13, 14 has an opening 15 connecting its interior with a resonance tube 16. The said resonance tube 16 has only been partly shown. It has a length adapted to the desired sound frequency and the connection between the lower part 14 of the housing and the resonance tube 16 has been established by bellows 17. The lower membrane 9 and the housing part 14 form walls of a chamber 18.

The two membranes 8, 9 are made of a material conventionally used for membranes—normally a web covered with rubber. The ring shaped member 10 clamped between the flanges 11 and 12 are provided with a radially directed bore 19 connected to a vacuum source (not shown). The desired vacuum should be sufficient to cause the two membranes 8, 9 to constantly become bent inwardly towards each other—i.e. even when a maximum sub pressure is prevailing in the resonance tube 16 and even when the member 7 is accelerating to maximum extent.

Near its periphery the member 7 has been shaped to be of continuously decreasing thickness. The upper side of the member 7—which mainly is plane—has thus near its periphery a downwardly curved part 20 causing a decrease of the mechanical stress on the membrane 8. The lower side of the member 7 has a correspondingly curved part 21 near its periphery serving to decrease the mechanical stress on the membrane 9. Also the ring shaped member 10 has correspondingly curved surface parts 22 and 23 near the ring opening.

During operation of the sound generator air is evacuated via the bore 19 from the space between the membranes 8 and 9. The two membranes 8, 9 will closely come into contact with the upper resp. the lower surfaces on the two members 7 and 10. This is because the vacuum prevailing in the space between the membranes 8 and 9 is greater than the vacuum which is erected above the upper membrane 8 during the maximum downward acceleration of the membrane piston—resp. greater than the vacuum which is erected below the lower membrane 9 during the maximum upward acceleration of the membrane piston. In case no vacuum existed between the two membranes they would flutter and cause fatigue breakdown of the membrane material due to changes of the directions of stresses.

Now the two membranes 8, 9 will become constantly inwardly bent towards the space between them, and they will always be exposed to a tensile force—although a varying one. This will cause a substantial increase of the life time of the membranes—they should be able to perform at least 50 million piston strokes without cracking.

Figure 2:
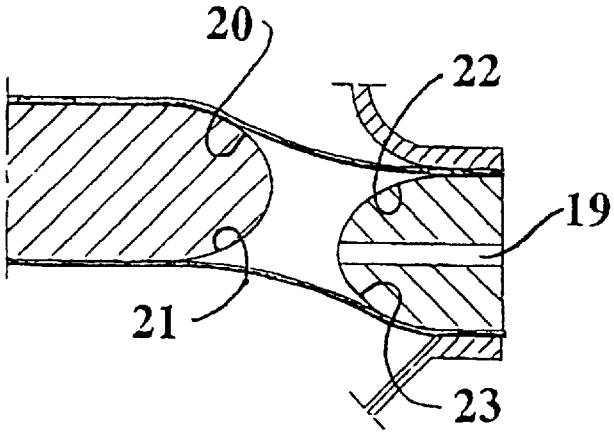
FIGS. 2–4 show three different positions of the piston membranes during a piston stroke.
Figure 3:
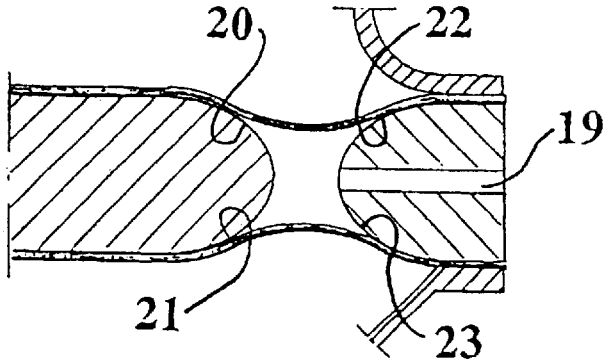
Figure 4:
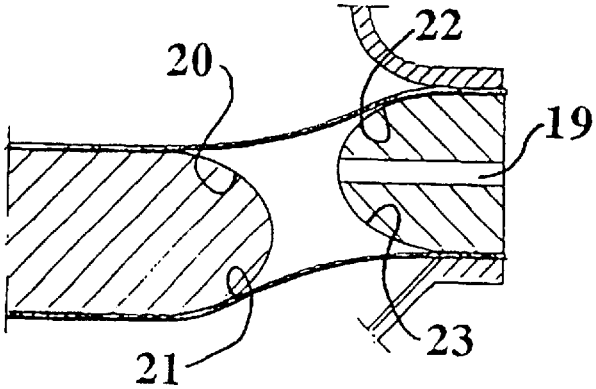

The FIGS. 2–4 show three different relative positions of adjacent parts of the two members 7 and 10 during a piston stroke.

FIG. 2 shows the upper end position of the piston 7-9 in which the speed of the piston is zero and the downward acceleration is of maximum value in case the motor is performing a steady rotation. If no vacuum existed between the two membranes 8, 9 the upper membrane 8 would not (as now shown) have been contacting the curved surface part 20 of the member 7. During the following downward travel of the piston the contact between the curved surface part 20 of the member 7 and the upper membrane 8 starts to decrease steadily. This is also the case regarding the contact between the lower membrane 9 and the curved surface part 23 on the member 10. Similarly—during the downward movement of the piston as shown in FIGS. 2–4 contact will be established between the curved surface 22 on the member 10 and the upper membrane 8 as well as between the curved surface 21 on the member 7 and the lower membrane 9.

Figure 5:
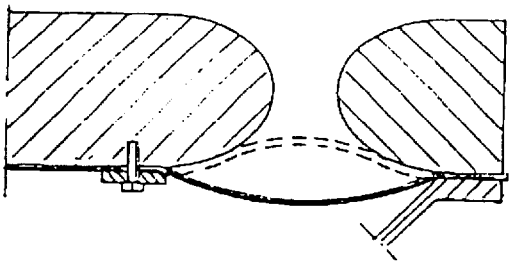
Fig. 5 PRIOR ART
FIG. 5 shows a conventional piston membrane.

FIG. 5 shows how a single membrane would flutter during the oscillations of the piston. The fully drawn lines show the position of the membrane during an upward movement of the piston, whereas the dotted lines show the membrane position during the downward movement of the piston.

The vacuum between the two membranes 8 and 9 may be provided by means of any kind of vacuum pump—e.g. a water ejector pump. The vacuum provided is easily kept at a value ensuring that the two membranes always are exposed to a tensile stress (however a varying one). Therefore, fatigue breakdown of the material in the membranes due to stresses of varying directions caused by air pressure variations in the chamber 18 will not occur.

By measuring the vacuum in the space between the membranes 8, 9 continuously it is easy to check that the membranes are intact.

A sound generator according to the present invention is cheap in operation, it may be used in the food industry and it is completely sealed against entrance of abrasive, finely divided material into vital parts of the sound generator.

I claim:

1. In a sound generator comprising a resonance tube and a device comprising a motor activating an oscillating piston for supplying gas pulses to the resonance tube via a connecting rod, in which said gas pulses form a standing sound wave and the piston is mounted within a chamber connected to the resonance tube, the improvement comprising in combination:

a membrane piston having two axially spaced membranes fastened to said wall of the chamber, and an evacuating channel located between the two membranes for establishing a vacuum between the two membranes.

2. The improvement defined in claim 1 further comprising a disc shaped member between said spaced membranes fastened to said connecting rod, with said disc shaped member having a thickness that decreases near an outer circumference of the disc shaped member to thereby reduce the space between two adjacent membrane surfaces in contact therewith.

3. The improvement defined in claim 1 further comprising a ring shaped member in contact with said membranes circumferentially surrounding said disc having a thickness that decreases near an inner circumference of the ring shaped member thereby to reduce the space between the surfaces of the two membranes.

* * * * *